United States Patent [19]

Leder

[11] 4,072,518

[45] Feb. 7, 1978

[54] METHOD OF MAKING TRIGONAL SELENIUM INTERLAYERS BY GLOW DISCHARGE

[75] Inventor: Lewis B. Leder, Rochester, N.Y.

[73] Assignee: Xerox Corporation, Stamford, Conn.

[21] Appl. No.: 755,704

[22] Filed: Dec. 30, 1976

[51] Int. Cl.[2] ..... G03G 5/082; B05D 3/06

[52] U.S. Cl. ..... 96/1.5 R; 427/39; 427/76; 427/83

[58] Field of Search ..... 96/1.5; 427/38, 39, 427/76, 83

[56] References Cited

U.S. PATENT DOCUMENTS

| | | | |
|---|---|---|---|
| 2,892,136 | 6/1959 | Escoffery | 427/83 X |
| 3,419,487 | 12/1968 | Robbins et al. | 427/38 X |
| 3,900,585 | 8/1975 | Matsubara | 427/39 X |
| 3,926,762 | 12/1975 | Goldstein | 96/1.5 X |
| 3,961,953 | 6/1976 | Millenzi et al. | 96/1.5 |
| 4,013,463 | 3/1977 | Leder | 96/1.5 |

FOREIGN PATENT DOCUMENTS

| | | | |
|---|---|---|---|
| 1,564,074 | 10/1969 | Germany | 96/1.5 |

*Primary Examiner*—Roland E. Martin, Jr.
*Attorney, Agent, or Firm*—James J. Ralabate; Eugene O. Palazzo; John E. Crowe

[57] ABSTRACT

A one-step process, method and corresponding xerographic photoreceptor obtained thereby, having all or part of the hole generating layer in the trigonal form, the process being effected and the photoreceptor obtained through the use of a glow discharge and ionizable inert gas.

8 Claims, No Drawings

METHOD OF MAKING TRIGONAL SELENIUM INTERLAYERS BY GLOW DISCHARGE

This invention relates to a convenient and efficient way of applying selenium or selenium alloy onto a base or substrate with minimal expenditure of time and energy, a controlled proportion of the deposited material being obtained in the trigonal form.

BACKGROUND OF THE INVENTION

Photoreceptors, particularly those related to xerographic copying, traditionally comprise a photoconductive insulating layer such as an element or alloy thereof exemplified by selenium (amorphous or trigonal) and selenium alloys such as a Se-As, Se-Te, Se-Bi, etc., with varying amounts of a halogen. These photoconductive materials are customarily applied in charge blocking contact to a supporting metal- or metal-covered substrate such as aluminum, steel, nickel, brass, NESA glass or corresponding metal-coated polymeric materials.

Functionally speaking, xerographic photoreceptors utilizing the above elements are generally given a uniform electrostatic charge and the sensitized surface exposed to an image pattern defined by an electromagnetic radiation, such as light. Light impingement effects the selective dissipation of the initially applied charge leaving a positive electrostatic image. The resulting (latent) electrostatic image is then developed by applying oppositely charged marking particles onto the charge-bearing photoreceptor surface.

The basic xerographic concept was originally described by Carlson in U.S. Pat. No. 2,297,691, and has been since amplified and redescribed in many related patents in the field. Generally speaking, however, photoconductive layers suitable for carrying out the above functions have a specific resistivity of about $10^{10} - 10^{13}$ ohm-cm, in the absence of illumination. In addition, their resistivity must drop at least several orders of magnitude where exposed to an activating radiation such as light.

Photoconductive layers meeting such criteria are expected to exhibit some loss in applied charge, even in the absence of light exposure. This phenomenon, known as "dark decay", unfortunately usually varies inversely with sensitivity and in direct proportion with usage of the photoreceptor. The latter characteristic is generally attributed to a natural tendency of selenium to convert from an amorphous to the crystalline (trigonal) form with passage of time and exposure to temperatures exceeding a predetermined range.

Control over the rate and conditions effecting such conversion, and its affect, is a matter of primary concern, particularly in view of the fact that modern xerographic photoreceptors have rather stringent demands with regard to increased spectral response and general photoconductive efficiency as well as good mechanical properties such as flexibility and durability. This has become particularly important in modern automatic copiers operating at high speeds where the photreceptor is in the form of an endless flexible belt (ref. U.S. Pat. No. 2,691,450). For example, high speed machine cycling conditions require particularly strong adhesion and durability between the photoconductive layer and the underlying substrate. Unfortunately, however, the most sensitive and efficient selenium photoconductive materials are relatively brittle and do not generally adhere well to a flexing metal substrate. It is also found to be very important that any interface between an electrically conductive supporting substrate and the photoconductive layer be chemically stable as well as strongly adherent since changes at this point will have a substantial effect on the electrical properties of a photoreceptor including dark decay.

In practice, the present or potential technical difficulties inherent in the modern usage of selenium have been solved only in part and by a trade off or compromise in properties.

First and foremost, hole-generating photoconductive layers, such as trigonal selenium, can be easily utilized in photosensitive members having a base, an imposed charge generating photoconductive layer and an external hole-transporting overcoat layer for selective discharge of the surface (sensitizing charge) in conformity with the area of light exposure.

The use of such material, however, tends to cause undesirable dark decay problems. A partial answer, in the more conventional xerographic mode, has been provided by incorporation of a thin barrier layer such as a dielectric film between the base or substrate and the photoconductive layer. U.S. Pat. No. 2,901,348 of Dessauer et al, for instance, utilizes a film of aluminum oxide of about 25 to 200 Angstrom also insulating adhesion-promoting polymeric resin layers, such as a polybenzimadazole, polycarbonate, polyester, polyurethane or polystyrene of about 0.1 to 3 microns thickness for such purpose. With some notable limitations, such barrier layers function remarkably well and allow many types of photoconductive layers to support a substantial charge. When activated by illumination, however, the photoconductive layer and barrier layer must also operate together to permit substantial dissipation of the applied charge in light-struck areas within a relatively short period of time and also provide a reasonably good spectral response range.

In addition to other needed properties the amount and type of alloy additives, such as arsenic, etc. are found to substantially stabilize or limit the rate of conversion of amorphous selenium to the crystalline trigonal form. Depending upon the type of device desired and its problems, however, it is sometimes necessary to have both the crystalline and non-crystalline form present initially as part of the photoconductive or charge-generating layers. On balance, therefore, flexibility and control over the form and type of charge generating layer to be laid down and stability are greatly to be desired.

It is an object of the present invention to obtain a process or method whereby charge-generating selenium or selenium containing photoconductive layers can be selectively and efficiently laid down to obtain desirable combinations of physical and electronic properties.

It is a further object of this invention to improve the flexibility and overall responsiveness of selenium-containing xerographic photoconductive material to the challenges of modern xerographic copying.

It is a still further object of the present invention to easily and efficiently control the initial amount of photoconductive crystalline selenium initially applied onto a base or substrate during coating operations and to maintain a stable relationship between crystalline and non-crystalline material deposited.

THE INVENTION

The above objects inclusive of a method for controlling the amount of crystalline photoconductive selenium or selenium alloy material applied to a base or substrate are achieved by at least initially exposing the base or substrate as a cathode to a vapor cloud comprising uncharged photoconductive material plus oppositely charged high energy photoconductive material and inert gaseous ions, the vapor cloud being obtained essentially by vaporizing selenium or selenium alloy in a vacuum coater in convenient proximity to a glow discharge in the presence of an inert ion-forming gas and thereafter briefly exposing the base or substrate, as desired, to an un-ionized vapor cloud at least initially comprising selenium and at least 0.3 wt. % arsenic.

Generally speaking, the resulting arsenic-containing barrier layer is at least about 0.1$\mu$ in thickness and may, when desired, be followed with pure amorphous selenium or other alloys of selenium or eliminated altogether if the entire charge-generating layer is to be crystalline. In this connection, the alloy barrier layer can usefully comprise a range of about 0.3–40wt. % arsenic/selenium alloy.

As above noted, suitable bases or substrates for purposes of the present invention can consist of NESA glass, a relatively thin metal foil of copper, steel, brass, aluminum, zinc, nickel or corresponding metal-coated flexible paper or coated polymeric base such as a coated polyethylene terephthalate. Typical substrate include flexible belts, sleeves, sheets, webs, plates, cylinders and drums. Of particular interest as substrates, however, are aluminum-coated polyethylene terephthalate, nickel and brass belts.

Photoconductive materials suitable for use in the instant process are generally inorganic ionizable elements, such as selenium, selenium alloys inclusive of alloys of selenium with tellurium, germanium, antimony, bismuth and arsenic and/or one or more halogens such as chlorine, bromine, or iodine. Such photoconductive materials are obtainable, for instance, by subjecting selenium plus arsenic, etc., and halogen to heat.

For purposes of the present invention, the base or substrate can usefully include thin adhesion-promoting or charge blocking layers such as described above and in reference to U.S. Pat. No. 2,901,348.

Both cleaning of the base or substrate and application of at least one type of charge-blocking layer can usefully be incorporated, if desired, into the general application steps in accordance with the present invention by initial bombardment of the base or substrate as a cathode with positive ions of an inert non-metallic gas in a vacuum coater. This is best carried out by evacuating the coater to a pressure of about $3 \times 10^{-5}$ Torr or better, then backfilling with up to about 5–30 micron (mercury) pressure of a mixture of argon, xenon, krypton or neon and oxygen or $CO_2$. For such purposes a backfill pressure of about 10–15 microns (mercury) is found best and the heaviest inert gases are preferred.

Maintenance of a satisfactory glow discharge for the above purposes of carrying out the above described optional ion bombardment and oxidation of a base or substrate can be satisfactorily effected for purposes of the present invention under a DC field at a potential ranging from about 1500 to about 3500 volts and a cathode current density of about 0.05–0.5 ma/cm$^2$, depending upon the type and pressure of gas used to form the ions. Alternatively, a low frequency AC glow discharge of about 60–400 cycles, a potential of about 500 to about 1400 volts and a substantially reduced current density of about 0.01–.15 ma/cm$^2$ is also found to be sufficient for the above purpose.

Adhesion-promoting and/or charge-blocking layers as above described can also be applied to a precleaned base or substrate surface by conventional means such as spraying or exposing the surface to a dilute solution of the desired material and/or by a combination of acid etching and anodization in the manner and under the conditions described, for instance, in U.S. Pat. No. 3,907,650 of H. Pinsler.

Suitable inert ion-forming gases for purposes of the present invention can include, for instance, one or more of argon, xenon, krypton, neon or even nitrogen provided the amount and energy of the combined selenium and inert gas ions is sufficient to provide a sufficient number of nucleation sites commensurate with the overall vapor deposition rate onto the base or substrate.

The step of exposing the base or substrate to a vapor cloud as described, supra, is essential in obtaining the controlled application of crystalline (trigonal) selenium onto the required surface. This step is carried out "in situ" under a DC or AC glow discharge essentially as described above.

For purposes of a better understanding of the difference between the optional cleaning step, and the instant exposure step, it should be noted that almost all of the drop in applied potential occurs across the distance corresponding to the Cathode Dark Space of a glow discharge. The highest production and concentration of gas ions is normally expected in the area corresponding to the Negative Glow region. Thus, in the optional cleaning step, inert gaseous ions (nitrogen, argon, etc.) are produced in the Negative Glow region and are accelerated across the Cathode Dark Space and impact the base or substrate surface in the possible presence of oxygen and at an energy level considerably higher than that of a thermally excited atom or molecule. It is further noted, in this connection, that a glow discharge current can be easily monitored to determine when the base or substrate has been cleaned by ion bombardment since the glow discharge current gradually decreases to a lower steady state value. This is because the clean metal substrate surface has a lower secondary electron emission coefficient.

In the subsequent exposure (i.e., coating) step, however it is found necessary to eliminate or substantially limit the residual oxygen in the coater while retaining or introducing more of the inert gas as well as vaporized selenium or selenium alloy into the glow discharge.

In order to effectively obtain the referenced vapor pressure of photoconductive material for effecting the instant step the source (ex. crucible/electrode) can be conveniently heated in a number of different ways. Such include, for instance, resistance heating of one or more crucibles containing the selenium and/or selenium alloy, the use of an electron beam or gun directed at the contents of the photoconductor source, ion beam heating of the photoconductive material, etc. In any case, the optimum temperature will vary with the photoconductive material, the geometrical distance between the vapor source and the base or substrate, and the particular coater pressure utilized. By way of example, a (crucible) temperature up to about 450° C and usually about 210° C–350° C is found adequate for vaporizing selenium and most of the known selenium alloys under a coater pressure up to about 30 microns (mercury).

Generally speaking, however, the temperature of the base or substrate is optionally in a somewhat lower temperature range of about 40° C–85° C for coating purposes. The lower temperature favoring the amorphous selenium form.

In any case the preferred temperature ranges within the coater should (1) favor maximum vapor concentration and field conditions commensurate with maintenance of a glow discharge proximate to a heated selenium source and to the base or substrate (ex. cathode) and (2) favor the highest possible conversion of uncharged to high energy charged photoconductive material and inert gas ions to effect the highest possible number of impactions of high energy ionized photoconductive material against the surface of the base or substrate.

Since the ionization efficiency of both a DC and AC glow discharge is normally quite low (about 1–8%), the energy and weight of the inert ion forming gas used is also considered significant in carrying out "in situ" crystallization of the selenium material as deposited. While the exact reaction mechanism is not known, it is probable that the initial points of ion impact become nucleation sites on the base surface and that the sustained bombardment with high energy inert gaseous ions such as argon are helpful in converting the bulk of the deposited un-ionized condensed selenium into the crystalline form on or about each nucleation site.

In addition, there is also a tendency to displace some of the applied (uncharged) low energy photoconductive material from the base or substrate by bombardment with the gaseous and metallic ion components of the vapor cloud. In effect, such bombardment over a period of time has a tendency to create a number of primary and secondary nucleation sites substantially in excess of those anticipated solely from the percentage of ions generated in a glow discharge. Moreover, such sites tend to favor the deposit of additional crystalline selenium even if effected under subsequent conditions generally favoring the deposit of the amorphous form.

Where a multi-layered charge-generating photoconductive layer is desired, therefore, it is possible but not always necessary or desirable to lay down the full amount of the crystalline layer under glow discharge. This is particularly true if the ambient temperature within the coater itself is relatively high. In such case the presence of a 0.3–40 wt. % arsenic/selenium barrier layer or overcoat can be of substantial help in stabilizing or checking further crystallization particularly in the case where a desired amount of amorphous selenium is to be laid down. This would also be desirable, for instance, where dark discharge characteristics of the photoconductor would be affected by the crystalline layer. As a practical matter, such control can be easily exercised in the coater under continuing vacuum by simply programming the opening or closing of one or more shuttered crucibles or heating means thereof to vaporize charges of photoconductive material in the desired order and thereby obtain the necessary composition of un-ionized vapor cloud.

The following examples specifically demonstrate preferred embodiments of the present invention without limiting it thereby.

EXAMPLE I

A nickel alloy test belt identified as A-1 and having a thickness of 4.5 mil (0.0045 inches), a length of 10 inches and a circumference of 15 inches, is cleaned with a hot aqueous solution containing 10% by weight of "Mitchell Bradford #14 Cleaner" and rinsed in deionized water for about 2 minutes.

The belt is then mounted on a rotatable mandrel insulated from ground in a vacuum coater about 6 inches away from 2 shuttered stainless steel crucibles equipped with resistive heating means and containing respectively 99.9% pure selenium and a selenium alloy consisting of about 95% selenium and 5% arsenic. After evacuating the coater to $5 \times 10^{-5}$ Torr and then backfilling with about 10μ (mercury) pressure of air, a glow discharge having a cathode current density of .1 ma/cm$^2$, is formed by applying a 3000v electrical potential using the test belt as cathode and the shuttered pure selenium-containing stainless steel crucible as anode. After 8 minutes of glow at the above pressure, the coater is backfilled with argon gas to bring the pressure to about 30μ (mercury) and the shutters of the preheated (225° C) crucible containing 99.9% selenium are opened for about 2 minutes. During this period the belt is constantly rotated at about 10 revolutions per minute to lay down a uniform 3μ layer of trigonal selenium. The first crucible is re-shuttered, the glow discharge is turned off, the pressure reduced to $5 \times 10^{-5}$ Torr and the second preheated crucible, containing arsenic/selenium alloy, is opened (280° C.) for 1 minute. The first crucible is then reopened for about 14 minutes to obtain a total deposition of about 50μ. The coater is then permitted to return to ambient temperature and pressure. The belt is examined by electron microscopy in cross-section and tested for electrical characteristics. The results are reported in Tables I and II below.

EXAMPLE II

A nickel alloy test belt identified as A-2 and identical with the belt of Example I is precleaned and mounted in the identified vacuum coater equipped with two stainless steel crucibles and coated as in Example I except that the glow discharge is terminated after the first 8 minutes. The crucibles are then opened in sequence as in Example I and the coater is allowed to return to a condition of ambient temperature and pressure after a total of 25 minutes. The resulting test belt is examined as in Example I and reported in Tables I and II below.

EXAMPLE III

A nickel alloy test belt identified as A-3 and substantially identical to that used in Example I is cleaned with an aqueous solution containing 10% by weight of "Mitchell Bradford #14 Cleaner", rinsed in deionized water for about 5 minutes, immersed in an acid wash solution (10% by volume 85.5% $H_3PO_4$) for 1 minute and then immersed for 10 minutes at 60° C. in an etching bath containing 18 g/liter KCl, 150 ml/liter of 85.5% $H_3PO_4$, and .21 g/liter of 10% chloroplatinic acid ($H_2PtCl_6 \cdot 6H_2O$) as a catalyst. The belt is again rinsed for 5 minutes in deionized water, air dried and mounted as in Examples I and II in the identical vacuum coater used heretofore. The coater is pumped down to about $5 \times 10^{-5}$ Torr and then backfilled with argon up to 30μ (mercury) pressure. A glow discharge is then begun and the preheated first (99.9% selenium containing) crucible opened for 10 minutes while rotating the test belt as in Example I. After laying down a uniform 3μ layer of trigonal selenium, the first crucible is re-shuttered, the glow discharge turned off, the pressure reduced to $5 \times 10^{-5}$ Torr and the second preheated crucible (280° C) is opened for 1 minute. Thereafter, the first crucible is reopened for about 14 minutes to obtain a total deposition as in Example I. The test belt is removed, examined and tested as before and the results reported in Tables I and II below.

Table I

| Example | Oxide Thickness (Angstrom) | Crystalline Layer* (u) | 5%As/Se Layer (u) | Se Thickness (u) | Coating Adhesion** | Mandrel Bend Test*** |
|---|---|---|---|---|---|---|
| I | 35 | 3.4 | 5 | 43 | Ex | 1¼" |
| II | 35 | 0 | 5 | 45 | P | 2" |
| III | 100 | 3.2 | 5 | 42 | Ex | 1¼" |

*using electron microscopy
** Ex = Excellent
** P = Poor
***one bend across mandrell of indicated diameter inches without cracking or spalling Table II

| Example | Photosensitivity Volts Cm²/erg um½ At 400 nm | At 600 nm | Initial Potential (Volts) | Dark Decay (1.25 sec. in volts) | Residual (volts) |
|---|---|---|---|---|---|
| I | .35 | .05 | 1020 | 6.7 | 3.9 |
| II | .36 | .001 | 954 | 75.2 | 2.3 |
| III | .34 | .05 | 982 | 11.1 | 2.7 |

What is claimed is:

1. A method for controlling the amount of crystalline photoconductive selenium or selenium alloy material initially applied to a xerographic base or substrate comprising exposing the base or substrate, as a cathode, to a vapor cloud comprising uncharged photoconductive material plus oppositely charged high energy photoconductive material and inert gaseous ions; the vapor cloud being obtained essentially by vaporizing selenium or selenium alloy in a vacuum coater in convenient proximity to a glow discharge in the presence of an inert ion-forming gas and thereafter exposing the base or substrate to an un-ionized vapor cloud at least initially comprising selenium and at least .3% by weight arsenic.

2. The method of claim 1 wherein the inert ion-forming gas is one or more of argon, xenon, krypton, neon or nitrogen.

3. The method of claim 2 wherein exposure to the unionized vapor cloud is maintained under vacuum for a period sufficient to lay down at least about a .1μ layer of a 0.3%–40wt.% selenium/arsenic alloy by weight.

4. The method of claim 3 wherein an amorphous selenium coat is vacuum coated over the 0.3%–40wt.% selenium/arsenic alloy.

5. The method of claim 1 wherein (a) one or more crucibles containing selenium or selenium alloy and (b) one or more bases or substrates are utilized, respectively, as electrodes in forming the glow discharge.

6. The method of claim 3 wherein the inert ion-forming gas is argon.

7. The method of claim 3 wherein the inert ion-forming gas is xenon.

8. The method of claim 4 wherein the base is of aluminum, nickel, brass, stainless steel or corresponding metal-coated polymeric material.

* * * * *